United States Patent [19]

Peckar

[11] 4,119,204

[45] Oct. 10, 1978

[54] RESTRAINING STRUCTURE FOR USE IN CONTAINERS

[75] Inventor: George E. Peckar, Stamford, Conn.

[73] Assignee: The Chaspec Manufacturing Co., Stamford, Conn.

[21] Appl. No.: 766,268

[22] Filed: Feb. 7, 1977

[51] Int. Cl.[2] ..... B65D 81/02

[52] U.S. Cl. ..... 206/521; 206/480; 206/592; 211/41

[58] Field of Search ..... 206/313, 521, 542, 546, 206/356, 449, 453, 472, 480, 477, 523, 564, 565, 586, 591, 592, 332, 363, 478, 822; 211/41; 248/350

[56] References Cited

U.S. PATENT DOCUMENTS

| | | | |
|---|---|---|---|
| 2,821,307 | 1/1958 | Linsley | 206/332 |
| 2,883,061 | 4/1959 | Moore | 206/480 |
| 2,905,351 | 9/1959 | Lerner | 248/350 |
| 3,850,296 | 11/1974 | Hirata | 211/41 B |
| 3,927,782 | 12/1975 | Edwards | 248/350 |
| 3,942,671 | 3/1976 | Florian | 206/564 |
| 4,006,818 | 2/1977 | Wannyn | 206/564 |

*Primary Examiner*—Herbert F. Ross
*Attorney, Agent, or Firm*—Amster, Rothstein & Engelberg

[57] ABSTRACT

A surface for mounting an item in a container is provided with clamping members which restrain the item against the surface. Each clamping member includes a frustum-shaped lug having a gripping portion on its periphery, and also has a resilient member for mounting the lug to the mounting surface so that at least a portion of the lug is movable in a generally perpendicular direction with respect to the mounting surface. In use, a plurality of clamping members are secured to the mounting surface so that their gripping portions engage the perimeter of the item when it is received on the mounting surface. With the item in this position, the clamping members restrain it against the mounting surface.

8 Claims, 5 Drawing Figures

RESTRAINING STRUCTURE FOR USE IN CONTAINERS

This invention relates generally to structures for shipping and for displaying fragile items, and more particularly concerns structures which may be incorporated in containers to restrain the items in those containers.

Protective containers are widely used throughout industry and commerce for shipping fragile items. Such containers have been adapted for shipping individually packaged items and have been designed for conversion to attractive display containers useful at the point of sale for exhibition purposes, for advertising or for home display of the items by the consumer. Such containers must protect and restrain the contained item to prevent it from being damaged as a result of the rough handling it is likely to receive during shipment. Furthermore, when it is placed on display, the contained item should also be well restrained in the container to prevent it from being dislodged and dropped during handling and inspection by customers.

Although containers have been available for shipping and displaying fragile items, they typically have a number of significant disadvantages, specifically when used for such as china plates, and the like. For example, certain prior art containers must be specially assembled for shipping or they must have auxiliary packing materials added to the package to protect the contained item during shipment and to restrain it against movement. With such containers the packing materials must be removed before they can be rearranged or reassembled to convert them for display purposes. When it becomes necessary to repack the item, such as after a sale has been made to the consumer, the package has to be reassembled (assuming the extra parts are still available). In addition to the cost of these extra pieces and their inherently unattractive appearance, the labor expenses incurred in setting up the display are suffered again in the repacking.

Jewelry boxes for holding watches, and the like, have been provided with inserts having springlike gripping fingers for holding the inserted item, but such an arrangement alone (as without some auxiliary means to restrain the item) do not prove satisfactory for retaining larger and heavier items, which have a tendency to shake loose from the gripping fingers during shipping.

A particular problem encountered in restraining china plates, for example, is that the actual size and height of the plate may vary from the nominal dimensions. Spring fingers of the type used to retain watches in jewelry cases are not efficient to hold china plates because they are not strong enough for that purpose, they do not allow for customary size variations, they do not provide a positive lock for the fragile items and, for large sized items, they are too expensive.

Broadly, it is an object of this invention to provide a container for shipping and displaying fragile items which container overcomes disadvantages of existing containers. Specifically, it is within the contemplation of the present invention to provide an improved container for shipping, storing and displaying fragile items and a mounting means to hold and attractively display such items.

It is another object of this invention to provide a container for shipping and displaying containable items in which container auxiliary packing materials need not be used to restrain the contained item during shipping.

It is yet another object of this invention to provide a container for restraining a contained item against movement which container protects the item against damage during shipment and handling and also serves as an attractive display case.

It is a further object of this invention to provide a structure for restraining an item which may vary significantly from its nominal size, which structure effectively restrains items having the greatest variation from the nominal size.

It is yet another object of this invention to provide a structure for restraining an item in a container which, under rough handling, will not release the item when the container is closed.

It is also an object of this invention to provide restraining structures and containers meeting the aforementioned objectives which are reliable and convenient in use, attractive in appearance, yet relatively simple and inexpensive in construction.

In accordance with one aspect of the invention, a surface formed to mount an item in a container is provided with a clamping member which restrains the item against that surface. The clamping member includes a generally frustum-shaped lug having a gripping portion on its periphery and also has a resilient member for mounting the lug to the mounting surface so that at least a portion of the lug is movable in a generally perpendicular direction with respect to the mounting surface. In use, for example with a china plate, a plurality of clamping members are secured to the mounting surface so that the gripping portions engage the rim of the plate when the plate is received on the mounting surface. With the plate in this position, the clamping members restrain it against the mounting surface.

In accordance with an illustrative embodiment demonstrating objects and features of the present invention, there is provided an elegant container for shipping and displaying a fine china plate. The container includes a main housing containing a mounting insert for the plate, and has a hinged lid for closing the container. The mounting insert, which is secured inside the main housing is made from a sheet of resilient, sturdy material and is formed with a recessed seat for receiving the plate. A plurality of clamping members, of the type described, are positioned around the perimeter of the seat so that their gripping portions protrude over the seat in position to engage the rim of the plate received thereon. In this embodiment of the mounting insert, resilient mounting of the lug to the insert is achieved by joining the mounting lug to the remainder of the mounting insert with flexible material which is formed into a generally U-shaped channel around the base of the lug. The plate is mounted in the container by being pressed downward into the recessed seat. Owing to their resilient mounting, the lugs are displaced when the plate is forced downward, but snapped back over the plate when it is fully seated. Thus, their gripping portions engage the rim of the plate and retain the plate in the seat. This construction not only provides a snap-in-fit for plates that may vary to some degree in size, but serves to lock the plate in position when the lid of the container is closed. This locking is achieved because the lid engages the tops of the lugs and substantially restricts their movement. As a result, when the container is securely closed, the lugs will not be displaced and the plate will not be released, even under rough handling.

The foregoing brief description, as well as further objects, features and advantages of the present invention, will be more completely understood by referring to the following detailed description of a presently preferred, but nonetheless illustrative, embodiment of the invention, in association with the accompanying drawings wherein.

Figure 1:
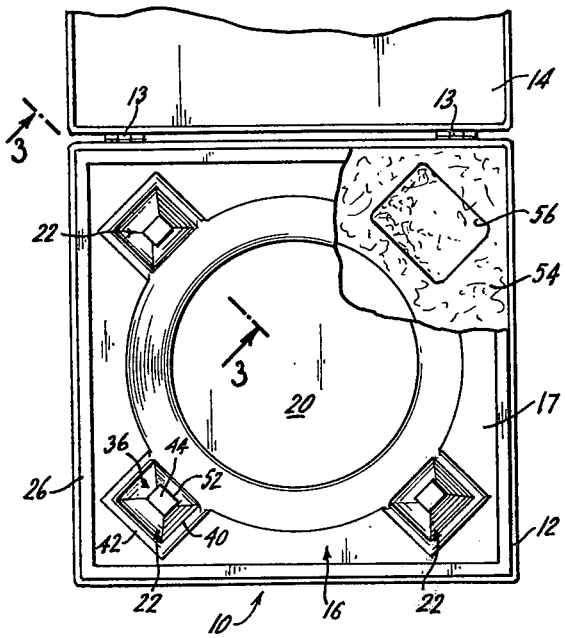
FIG. 1 is a top plan view of a container for a china plate which incorporates objects and features of the present invention, the container being shown with its cover open and with a portion of the plate mounting insert cut away to show internal construction details.
Figure 2:
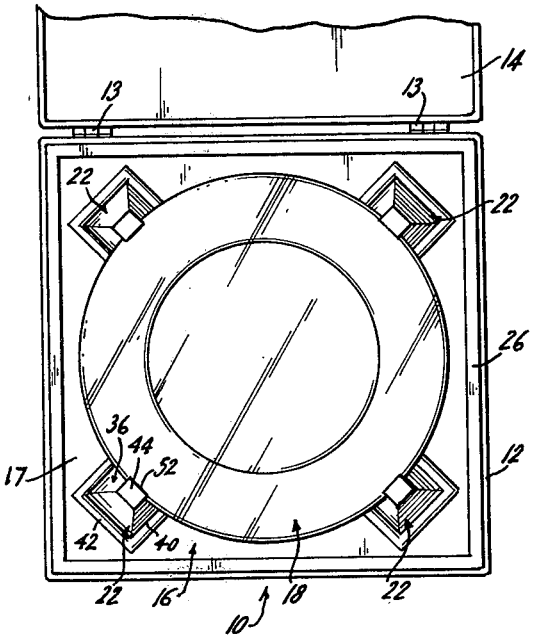
FIG. 2 is a top plan view showing the container of FIG. 1 with a china plate restrained in its mounted position in the container.

Referring now to the details of the drawing and, in particular, to FIGS. 1 and 2, there is shown an elegant container 10 for shipping and displaying china plates, which container incorporates objects and features of the present invention. The container includes a main housing 12 and a cover 14 mounted to the main housing by means of hinges 13, or the like, to permit convenient opening and closing of the container. Inside the main housing 12, there is secured a mounting surface, in this case the mounting insert 16, which is adapted to receive and retain a china plate 18. The insert 16 includes a recessed seat or well 20 which is formed to receive the plate 18, and has a plurality of clamping membes 22 positioned around the perimeter of the seat 20 to restrain the plate 18 in the mounting insert 16 when it is placed in seat 20.

Mounting insert 16 may be made of any strong, resilient material and may be shaped by conventional processes; the illustrated embodiment has been successfully made of a milled, high impact, styrene plastic sheet which is vacuum or pressure formed. In the illustrative embodiment, the single, homogeneous, and easily formed styrene sheet includes the recessed seat 20 and the clamping members, including the resilient lug mounting means to be described below (see FIG. 3). Mounting insert 16 also includes a peripheral skirt 24 which is constructed to conform to and contact the inner perimeter of main housing 12 and which is useful to conveniently secure the insert 16 to the main housing 12. A ridge 26 is formed about the perimeter of mounting insert 16 to lend rigidity thereto and to give the appearance of a frame. The entire outer surface of mounting insert 16 may be flocked or appropriately decorated to lend elegance to the appearance of container 10.

Figure 3:
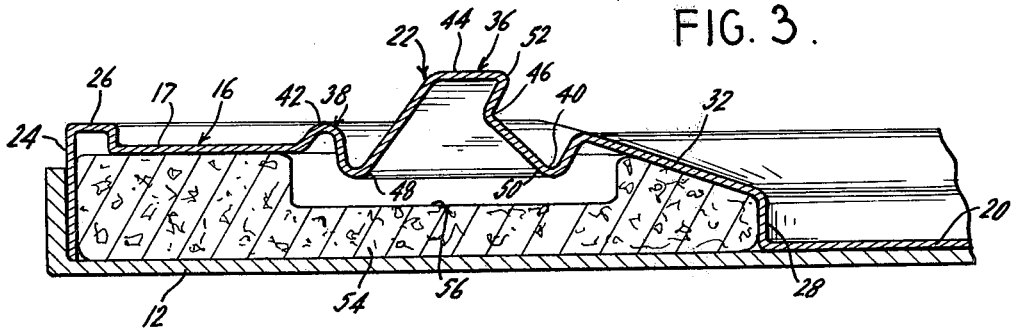
FIG. 3 is a fragmentary sectional view, on an enlarged scale, taken along the section line contour 3—3 of FIG. 1 and looking in the direction of the arrows to illustrate further construction details of the container.
Figure 4:
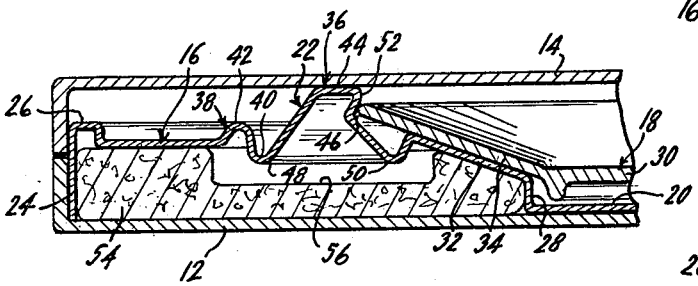
FIG. 4 is a fragmentary sectional view similar to FIG. 3 and shows the container with a plate mounted therein and with the cover of the container closed.
Figure 5:
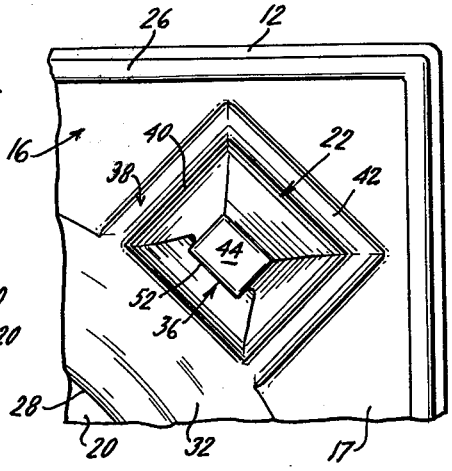
FIG. 5 is a top plan view, on an enlarged scale, of a clamping member incorporating objects and features of the present invention.

As best seen in FIGS. 3 and 4, recessed seat 20 is shaped to conform to the bottom surface of plate 18. Thus, seat 20 includes a generally cylindrical lower portion 28 which allows clearance for the bottom 30 of plate 18, and has a generally conical portion 32 which is generally complementary to and which engages the sloping portion 34 of plate 18 when the plate is fully seated in mounting insert 16.

Each of clamping members 22 includes a lug portion 36 and resilient means comprising a flexible lug mounting portion 38. Mounting portion 38 includes a generally U-shaped channel 40 formed about the base of lug 36, and has a ridge 42 formed around the outer perimeter of channel 40. Ridge 42 provides rigidity to mounting insert 16 in the vicinity of lug 36 and further cooperates with channel 40 to resiliently mount lug 36. By virtue of this construction of mounting portion 38, lug 36 is mounted to insert 16 so that portions of the lug are resiliently movable in a generally perpendicular direction with respect to upper surface 17 of insert 16 as well as parallel thereto, as will be more fully explained hereinafter.

In the illustrative embodiment, lug 36 is formed in the general shape of a frustrum of a pyramid; this produces relative rigidity for the lug 36 per se. However, it will be appreciated that lug 36 may be formed in various shapes that will exhibit the requisite rigidity. Each of lugs 36 includes a substantially flat top 44 and, on the side thereof, the facing seat 20 includes an inwardly directed hook-shaped cut out or gripping portion 46.

From the construction of lug 36 and mounting portion 38 described thus far, it will be appreciated that, if a downward force is applied to flat top 44, lug 36 will move downwardly and channel 40 will be deformed. As a result of its deformation, channel 40 exerts an upward resilient force on lug 36 so that lug 36 will be urged upwardly to its original position when the externally applied force is removed. Furthermore, if a horizontal force is directed into gripping portion 46, lug 36 will swivel leftward (in FIG. 3) so that portion 48 of lug 36 will move downwardly and portion 50 of lug 36 will move upwardly. As a result of being distorted, channel 40 will apply a force to lug 36 which opposes the force applied at gripping portion 46 and the lug, therefore, will tend to return to its original position when this force is removed.

Referring now to FIG. 4, it will be observed that clamping members 22 and insert 16 are formed so that the portion 52 of each of lugs 36 overhangs the edge or rim of a seated plate 18. Consequently, when the plate is first inserted into seat 20 and is pressed downward, the edge of the plate engages portion 52 of each of the lugs and causes the lugs to swivel away, so that the plate may be seated. As soon as the plate is seated, however, the lugs 36 are forced back towards plate 18 by virtue of the resilient force applied to each of them by the corresponding mounting portion 38. This resilient force is applied by the gripping portions of the lugs against plate 18 and the plate is restrained within seat 20. Clamping members 22 accommodate plates exhibiting the variation in both diameter and rim height encountered with fine china plates while still providing a sufficient force to hold the plate within seat 20 when container 10 is picked up or handled by a customer.

Additional restraint of plate 18 is achieved by closing cover 14 of container 10 (See FIG. 4). When the cover is closed and firmly held in that position, it engages the flat top 44 of each of lugs 36 and restrains the lug against upward or swivel movement. In addition, the lugs are constructed so that cover 14 depresses them slightly, so an additional downward force is applied to plate 18 which prevents the lugs 36 from moving away from plate 18. As a result, lugs 36 do not move even under rough handling, for example, during shipping and plate 18 cannot be shaken loose.

It has been found that a mounting insert 16, constructed as described thus far, is adequate for restraining a plate against movement during shipping under most situations. However, under certain circumstances. to provide a firm undersupport, such as for the entire mounting insert 16, a platform 54 can be provided as shown beneath the mounting insert 16. In order that platform 54 does not interfere with the movement or displacement of lugs 36, a recess 56 is provided im platform 54 under each of the clamping members 22. In the preferred embodiment, platform 54 is formed from styrofoam, but any other conventional supporting material may be used.

The unit 12 forms an attractive frame for the display of an item such as a china plate 18. With the cover 12 and the associated hinges removed, the unit may be used as a display stand either in a sales situation or in a home and with appropriate longer means may be used as a wall frame. Of course, the mounting insert, or its equivalent, may be incorporated into a variety of well known frame or plaque arrangement for mounting and displaying various types of products.

Although a specific embodiment of the invention has been disclosed for illustrative purposes, it will be understood by those skilled in the art that many additions, modifications and substitutions are possible without the departing from the scope and spirit of the invention as disclosed above and defined in the accompanying claims. For example, mounting insert 16 need not be formed as a single unit. Clamping members 22 could be formed on individual pedestals and could be secured through means providing the necessary flexibility, directly to the bottom of main housing 12 in a position to restrain a contained item. Those skilled in the art will develop other variations and embodiments of the invention. Devices in accordance with the invention may be advantageously used for shipment, storage and/or display of a wide variety of products, both fragile and otherwise, and of a wide variety of shapes.

What is claimed is:

1. A mounting surface having at least two clamping members on said surface formed to receive and restrain, on said mounting surface, a body which includes a grippable edge, each clamping member comprising:

a lug having a gripping portion thereon;

resilient means on said mounting surface for movement of said lug generally perpendicular to said mounting surface; said lug and said resilient means on said mounting surface are formed as a unit from *s* single sheet of resilient material, said clamping member being constructed and arranged so that said gripping portions engage said grippable edge when said body is received on said mounting surface, whereby said body is retained on said mounting surface by said lug.

2. The clamping member of claim 1 wherein said lug is shaped generally like a frustum of a pyramid, said gripping portion being generally hook-shaped and formed on the periphery of said lug.

3. A mounting surface for receiving and retaining a body including a gripable edge, said mounting surface comprising:

a seat formed in said surface to receive said body with its edge above said seat; and a plurality of clamping members formed integral with said surface and spaced around the perimeter of said seat for retaining said body on said seat, each of said clamping members comprising:

a lug having a gripping portion thereon directed generally towards the center of said seat; and resilient means on said mounting surface for movement of at least a portion of said lug generally perpendicular to said seat in said mounting surface;

each of said clamping members being constructed and arranged so that said gripping portion engages said edge when said body is received on said seat, whereby said body is retained on said seat by said lugs.

4. A mounting surface in accordance with claim 3 wherein each of said clamping members, including said lug and said lug mounting means, is formed as a unit from a single sheet of resilient material, each of said lug mounting means including a generally U-shaped channel formed in said sheet about said lug.

5. The mounting surface of claim 3 wherein each of said lugs is shaped generally like a frustum of a pyramid, said gripping portion being generally hook-shaped and formed on the periphery of said lug.

6. A mounting surface in accordance with claim 3 wherein the entire surface, including said seat and said clamping members, is formed from a sheet of resilient material, said lug mounting means including a generally U-shaped channel formed in said surface about said lug.

7. In combination with a mounting surface in accordance with claim 3, a container including a main housing and a cover adapted to close said main housing, said main housing being constructed and arranged to have said mounting surface secured therein, said cover being constructed and arranged to engage at least a portion of each of said lugs when said container is closed, so that said lugs are restrained against movement.

8. In combination with a mounting surface in accordance with claim 6, a container including a main housing and a cover adapted to close said main housing, said main housing being constructed and arranged to have said mounting surface secured therein, said cover being constructed and arranged to engage at least a portion of each of said lugs when said container is closed, so that said lugs are restrained against movement.

* * * * *